US012117219B2

(12) United States Patent
Jang et al.

(10) Patent No.: US 12,117,219 B2
(45) Date of Patent: Oct. 15, 2024

(54) AIR CONDITIONER AND METHOD FOR CONTROLLING AIR CONDITIONER

(71) Applicant: LG ELECTRONICS INC., Seoul (KR)

(72) Inventors: Jiyoung Jang, Seoul (KR); Yongcheol Sa, Seoul (KR); Chiwoo Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 13 days.

(21) Appl. No.: 17/546,212

(22) Filed: Dec. 9, 2021

(65) Prior Publication Data

US 2022/0187001 A1 Jun. 16, 2022

(30) Foreign Application Priority Data

Dec. 11, 2020 (KR) ..... 10-2020-0173491

(51) Int. Cl.
*F25B 49/02* (2006.01)
*F24F 11/36* (2018.01)
*F25B 41/24* (2021.01)

(52) U.S. Cl.
CPC ..... *F25B 49/022* (2013.01); *F24F 11/36* (2018.01); *F25B 41/24* (2021.01); *F25B 49/02* (2013.01);
(Continued)

(58) Field of Classification Search
CPC . F24F 11/36; F25B 41/24; F25B 49/02; F25B 49/022; F25B 2500/22;
(Continued)

(56) References Cited

U.S. PATENT DOCUMENTS 11,199,337 B2 12/2021 Kawashima et al.
2019/0186777 A1* 6/2019 Kageyama ..... F24F 11/74
(Continued)

FOREIGN PATENT DOCUMENTS

CN 111902681 A 11/2020
EP 3467406 4/2019
(Continued)

OTHER PUBLICATIONS

Korean Office Action issued in Application No. 10-2020-0173491 dated Feb. 21, 2022.
(Continued)

*Primary Examiner* — Jonathan Bradford
(74) *Attorney, Agent, or Firm* — KED & Associates LLP

(57) ABSTRACT

An air conditioner may include an outdoor unit having a compressor; at least one indoor unit having an indoor heat exchanger, an indoor expansion valve, and a leak sensor that senses leakage of the refrigerant; a gaseous line; a liquid line; a first shut-off valve disposed adjacent to the at least one indoor unit that opens and closes the gaseous line; a second shut-off valve disposed adjacent to the at least one indoor unit that opens and closes the liquid line; a subcooling pipe branched from the liquid line and connected to an inlet of the compressor; a subcooling expansion valve that expands refrigerant, flowing through the subcooling pipe; and a controller configured to control operation of the compressor and to control opening and closing of the first shut-off valve, the second shut-off valve, the indoor expansion valve, and the subcooling expansion valve.

16 Claims, 6 Drawing Sheets

(52) U.S. Cl.
CPC ..... *F25B 2500/22* (2013.01); *F25B 2500/222* (2013.01); *F25B 2600/0251* (2013.01); *F25B 2600/2513* (2013.01); *F25B 2600/2515* (2013.01); *F25B 2600/2519* (2013.01); *F25B 2700/19* (2013.01)

(58) Field of Classification Search
CPC ..... F25B 2500/222; F25B 2600/2513; F25B 2600/2515; F25B 2600/2519; F25B 2700/19
See application file for complete search history.

(56) References Cited

U.S. PATENT DOCUMENTS

| | | | | |
|---|---|---|---|---|
| 2019/0249912 | A1* | 8/2019 | Yamada | F25B 13/00 |
| 2020/0011580 | A1 | 1/2020 | Matsuda et al. | |
| 2021/0247086 | A1* | 8/2021 | Sasaki | F24F 11/36 |
| 2021/0318041 | A1* | 10/2021 | Wakisaka | F25B 41/24 |

FOREIGN PATENT DOCUMENTS

| | | | |
|---|---|---|---|
| EP | 3 598 037 | A1 | 1/2020 |
| JP | 2011-021837 | A | 2/2011 |
| JP | 2013-178073 | A | 9/2013 |
| JP | 2019-143877 | | 8/2019 |
| JP | 2020-122646 | | 8/2020 |
| KR | 10-2003-0089179 | A | 11/2003 |
| KR | 10-0471723 | | 3/2005 |
| KR | 10-2014-0056965 | | 5/2014 |
| KR | 10-1678324 | | 11/2016 |
| KR | 6156528 | | 7/2017 |
| WO | WO 2017/203606 | | 11/2017 |
| WO | WO 2018/167820 | | 9/2018 |

OTHER PUBLICATIONS

European Search Report dated May 3, 2022 issued in Application No. 21212789.8.
Japanese Office Action dated Nov. 22, 2022 issued in JP Application No. 2021-199883.
Chinese Office Action dated May 9, 2023 issued in Application 202111483004.6 and English translation.

* cited by examiner

AIR CONDITIONER AND METHOD FOR CONTROLLING AIR CONDITIONER

CROSS-REFERENCE TO RELATED APPLICATION(S)

This application claims priority under 35 U.S.C. § 119 to Korean Application No. 10-2020-0173491 filed on Dec. 11, 2020, whose entire disclosure is hereby incorporated by reference.

BACKGROUND

1. Field

An air conditioner and a method for controlling an air conditioner are disclosed herein.

2. Background

Generally, an air conditioner is a cooling and heating system that cools a room by suctioning in hot air from the room and heat exchanging the air with a low-temperature refrigerant and then discharging the heat exchanged air into the room, or that heats a room by suctioning in cold air from the room and heat exchanging the air with a high-temperature refrigerant and then discharging the heat exchanged air into the room. The air conditioner is an apparatus that forms a series of cycles consisting of a compressor, a condenser, an expansion valve, and an evaporator.

Examples of air conditioners include an air conditioner in which one indoor unit is connected to one outdoor unit, and a multi-type air conditioner in which a plurality of indoor units are connected to one or more outdoor units, thereby producing the same effect as in the case in which multiple air conditioners are installed, for example. The multi-type air conditioner has a problem in that when refrigerant leakage occurs in refrigerant pipes connected to indoor units, a large amount of refrigerant remains stagnant in a narrow confined space, causing severe damage to the body of people in the indoor space.

Accordingly, in an existing method, leakage of refrigerant into the indoor space may be blocked by closing a shut-off valve disposed on the inlet and outlet side of an indoor unit, in which the refrigerant leakage occurs. However, the existing method has a problem in that it takes a predetermined amount of time until the shut-off valve is actually closed, and refrigerant may leak into the indoor space before the shut-off valve is actually closed.

BRIEF DESCRIPTION OF THE DRAWINGS

Embodiments will be described in detail with reference to the following drawings in which like reference numerals refer to like elements, and wherein.

DETAILED DESCRIPTION

Figure 1:
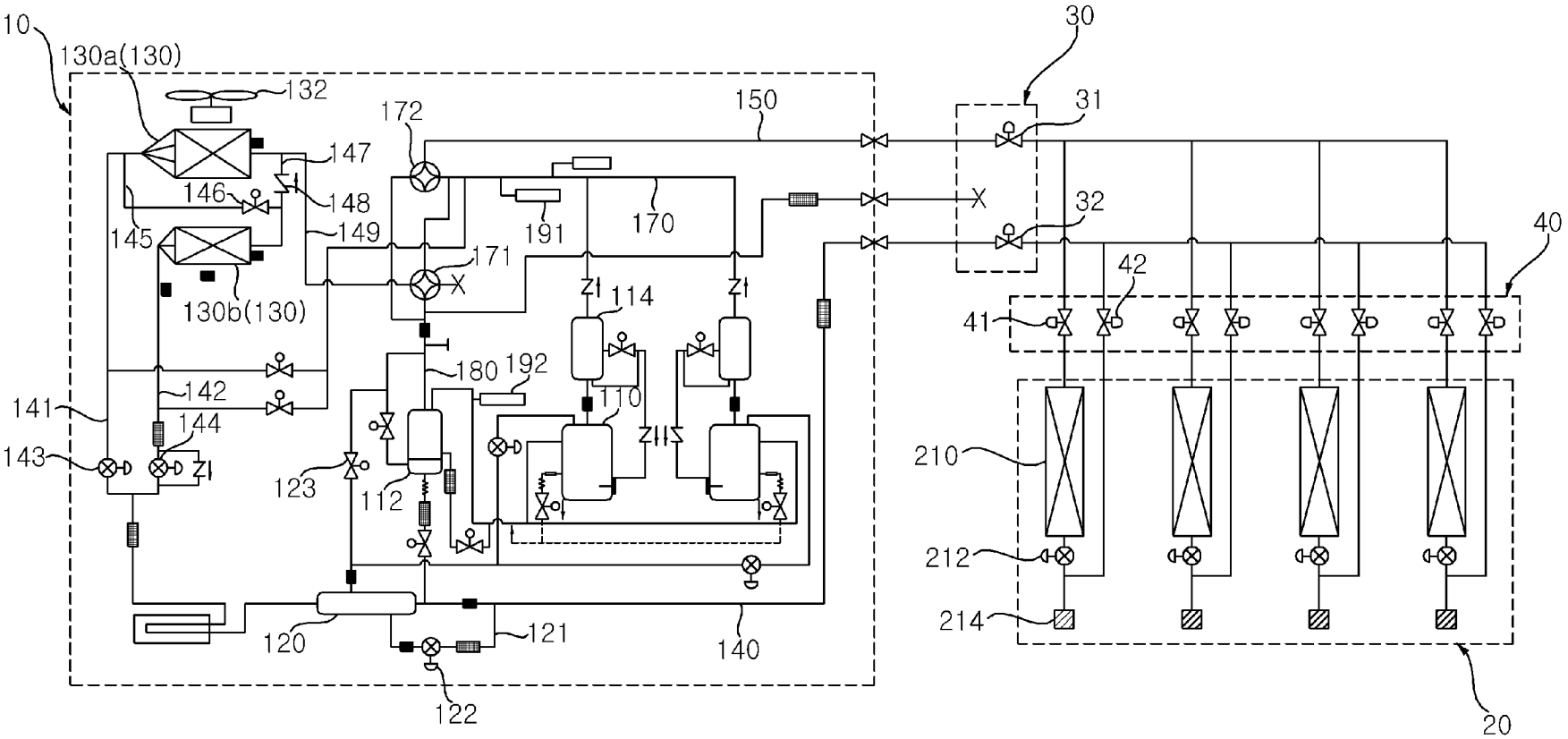
FIG. 1 is a schematic diagram of an air conditioner according to an embodiment.

Advantages and features and methods of accomplishing the same will be more clearly understood from embodiments described hereinafter with reference to the accompanying drawings. However, the embodiments are not limited to the following embodiments but may be implemented in various different forms. The embodiments are provided only to complete disclosure and to fully provide a person having ordinary skill in the art to which the embodiments pertains with the category, and the embodiments will be defined by the scope of the appended claims. Wherever possible, like reference numerals generally denote like elements through the specification.

The terminology used herein is for the purpose of describing particular embodiments only and is not intended to limit. As used herein and in the appended claims, the singular forms are intended to include the plural forms as well, unless context clearly indicates otherwise. It will be further understood that the terms "comprises" and/or "comprising," when used in this specification, specify the presence of stated components, steps, and/or operations, but do not preclude the presence or addition of one or more other components, steps, and/or operations.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments will be described with reference to the accompanying drawings.

FIG. 1 is a schematic diagram of an air conditioner according to an embodiment. Hereinafter, an air conditioner according to an embodiment will be described with reference to FIG. 1.

Air conditioner 1 according to an embodiment may include an outdoor unit 10 installed outdoors, an indoor unit 20 installed indoors, a total valve 30 disposed between the outdoor unit 10 and the indoor unit 20, and a shut-off valve 40 disposed at an inlet and an outlet of the indoor unit 20. The outdoor unit 10 may include a compressor 110 configured to compress a refrigerant; an oil separator 114 configured to separate oil from the refrigerant; an accumulator 112 configured to separate gaseous refrigerant and liquid refrigerant; a subcooler 120 configured to subcool the refrigerant; and an outdoor heat exchanger 130 configured to perform heat exchange between outdoor air and the refrigerant.

The compressor 110 may compress low-pressure gaseous refrigerant into high-pressure gaseous refrigerant. The compressor 110 may be an inverter compressor capable of varying a refrigerant compression capacity, for example.

An inlet of the compressor 110 may be connected to a second intermediate pipe 180, and the accumulator 112 may be disposed in the second intermediate pipe 180. An outlet of the compressor 110 may be connected to a first intermediate pipe 170, and the oil separator 114 may be disposed in the first intermediate pipe 170. A pressure sensor 190 that measures system pressure of the air conditioner 1 may be disposed at each of the inlet and the outlet of the compressor 110.

The accumulator 112 may separate the refrigerant, flowing into the compressor 110, into liquid refrigerant and gaseous refrigerant, and may supply only the gaseous refrigerant to the compressor 110. The oil separator 114 may be disposed at the outlet of the compressor 110. The oil separator 114 may separate oil from the refrigerant discharged from the compressor 110 and may return the separated oil to the compressor 110 from the oil separator 114 through an oil collection pipe connected to the compressor 110.

The first intermediate pipe 170, connected to the outlet of the compressor 110, branches off and is connected to a first valve 171 and a second valve 172. The first valve 171 and the second valve 172 are connected to each other via the first intermediate pipe 170, and switch a refrigerant passage according to a cooling operation and a heating operation of the air conditioner.

During the heating operation of the air conditioner, the first valve 171 may switch the refrigerant passage to connect an outdoor pipe 149 and the second intermediate pipe 180. During the cooling operation of the air conditioner, the first valve 171 may switch the refrigerant passage to connect the outdoor pipe 149 and the first intermediate pipe 170.

During the cooling operation of the air conditioner, the second valve 172 may switch the refrigerant passage to connect the second intermediate pipe 180 and a gaseous line 150. During the heating operation of the air conditioner, the second valve 172 may switch the refrigerant passage to connect the first intermediate pipe 170 and the gaseous line 150.

The subcooler 120 may be disposed in a liquid line 140. During the cooling operation of the air conditioner, the subcooler 120 may subcool the refrigerant heat exchanged by the heat exchanger 130.

A subcooling pipe 121 branches off from the liquid line 140 at an outlet side of the subcooler 120 and is connected to the inlet of the accumulator 112 or the inlet of the compressor 110. A subcooling expansion valve 122 that adjusts and expands an opening of the refrigerant passage of the refrigerant discharged from the subcooler 120, and a suction valve 123 that adjusts an amount of the refrigerant flowing into the accumulator 112 or the compressor 110 may be disposed in the subcooling pipe 121.

The outdoor heat exchanger 130 may include a plurality of refrigerant tubes, through which the refrigerant flows, and a plurality of heat transfer fins, thereby allowing heat exchange between the refrigerant and outdoor air. In this case, in order to further facilitate heat exchange, an outdoor fan 132 may be disposed near the outdoor heat exchanger 130 to supply outdoor air to the outdoor heat exchanger 130.

During the heating operation of the air conditioner, the outdoor heat exchanger 130 may be used as an evaporator to perform heat exchange between the refrigerant and the outdoor air, and during the cooling operation of the air conditioner, the outdoor heat exchanger 130 may be used as a condenser to perform heat exchange between the refrigerant and the outdoor air. There may be a single outdoor heat exchanger 130 or a plurality of outdoor heat exchangers 130. In this embodiment, the outdoor heat exchanger 130 includes first outdoor heat exchanger 130*a* and second outdoor heat exchanger 130*b*, which are connected in parallel with each other.

There may be a single indoor unit 20 or a plurality of indoor units 20. In this embodiment, a plurality of indoor units 20 is included.

The respective indoor units 20 may include indoor heat exchanger 210. The indoor heat exchanger 210 may include a plurality of refrigerant tubes, through which the refrigerant flows, and a plurality of heat transfer fins, thereby allowing heat exchange between the refrigerant and outdoor air. In this case, in order to further facilitate the heat exchange, an indoor fan (not shown) may be disposed near the indoor heat exchanger 210 to supply outdoor air to the indoor heat exchanger 210.

The indoor heat exchanger 210 may be used as an evaporator during the cooling operation of the air conditioner or may be used as a condenser during the heating operation of the air conditioner to perform heat exchange between the refrigerant and the outdoor air. In addition, a leak sensor 214 that senses leakage of refrigerant into an indoor space may be provided for the respective indoor units 20.

The air conditioner 1 according to an embodiment may include the liquid line 140, through which the liquid refrigerant flows, and the gaseous line 150 through which the gaseous refrigerant flows. The liquid line 140 may connect the outdoor unit 10 and the indoor unit 20. An indoor expansion valve 212 and outdoor expansion valves 143 and 144 may be disposed in the liquid line 140. The indoor expansion valve 212 may expand the refrigerant, supplied to the indoor heat exchanger 210, by adjusting an opening degree thereof during the cooling operation of the air conditioner. The outdoor expansion valves 143 and 144 may expand the refrigerant, supplied to the outdoor heat exchanger 130, by adjusting an opening degree thereof during the heating operation of the air conditioner.

One or a first end of the liquid line 140 may be branched to a first distribution pipe 141 and a second distribution pipe 142. The first distribution pipe 141 may be connected to the first outdoor heat exchanger 130*a*, and the second distribution pipe 142 may be connected to the second outdoor heat exchanger 130*b*. The other or a second end of the liquid line 140 may be branched to a plurality of liquid refrigerant distribution pipes. The plurality of liquid refrigerant distribution pipes may be respectively connected to each of the plurality of indoor heat exchangers 210. The outdoor expansion valves 143 and 144 may include first outdoor expansion valve 143 disposed in the first distribution pipe 141 and second outdoor expansion valve 144 disposed in the second distribution pipe 142.

The gaseous line 150 may connect the outdoor unit 10 and the indoor unit 20. As the second valve 172 is switched, one or a first end of the gaseous line 150 may be connected to the first intermediate pipe 170 or the second intermediate pipe 180, and the other or a second end thereof may be connected to the indoor heat exchanger 210. The other end of the gaseous line 150 may be branched to a plurality of gaseous refrigerant distribution pipes. The plurality of gaseous refrigerant distribution pipes may be respectively connected to each of the plurality of indoor heat exchangers 210.

The air conditioner 1 according to an embodiment may include a first bypass pipe 145 that branches off from the first distribution pipe 141 and connected to the second outdoor heat exchanger 130*b*, and a second bypass pipe 147 that branches off from the first bypass pipe 145 and connected to the outdoor pipe 149.

A control valve 146 may be disposed in the first bypass pipe 145. The control valve 146 may be opened during the cooling operation of the air conditioner, to allow the refrigerant, discharged from the first outdoor heat exchanger 130*a*, to be supplied to the second bypass pipe 147 and the second outdoor heat exchanger 130*b*. The control valve 146 is closed during the heating operation of the air conditioner, to prevent the refrigerant from flowing to the first bypass pipe 145.

A check valve 148 may be disposed in the second bypass pipe 147. The check valve 148 may prevent the refrigerant, discharged from the compressor 110 during the cooling operation of the air conditioner, from flowing to the second bypass pipe 147 through the outdoor pipe 149.

The air conditioner 1 according to an embodiment may include the total valve 30 disposed between the outdoor unit 10 and the indoor unit 20, and the shut-off valve 40 disposed adjacent to the indoor unit 20. At least one or more of the total valve 30 and the shut-off valve 40 may be disposed in the air conditioner 1 based on whether the compressor 110 is operated again, which will be described hereinafter.

The total valve 30 may control a refrigerant flow between the outdoor unit 10 and the indoor unit 20. The total valve 30 may be disposed at a front end where the liquid line 140 and the gaseous line 150 are branched to each of the plurality of indoor units 20. The total valve 30 may include a first total valve 31 disposed in the gaseous line 150 that opens and closes the gaseous line 150, and a second total valve 32 disposed in the liquid line 140 that opens and closes the liquid line 140.

The shut-off valve 40 may control a refrigerant flow between the outdoor unit 10 and the indoor unit 20. The shut-off valve 40 may be disposed adjacent to the indoor unit 20. The shut-off valve 40 may be disposed at each of the inlet and the outlet of the indoor unit 20. The shut-off valve 40 may include a first shut-off valve 41 disposed in the gaseous line 150 that opens and closes the gaseous line 150, and a second shut-off valve 42 disposed in the liquid line 140 that opens and closes the liquid line 140.

Figure 2:
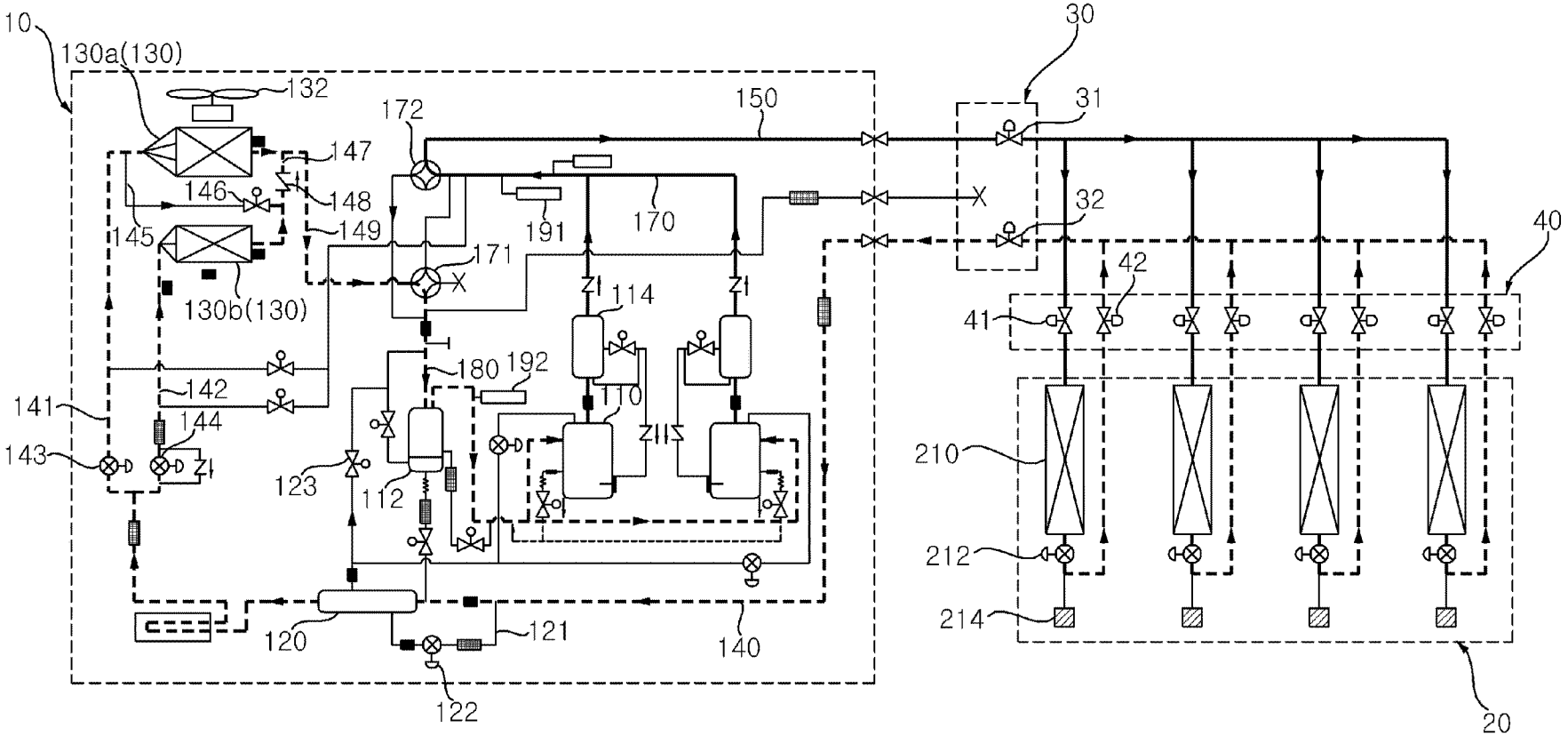
FIG. 2 is a schematic diagram illustrating refrigerant flow during a heating operation of an air conditioner according to an embodiment.

FIG. 2 is a schematic diagram illustrating refrigerant flow during a heating operation of an air conditioner according to an embodiment. Hereinafter, operation of an air conditioner during a heating operation and a refrigerant flow therein will be described with reference to FIG. 2.

A high-pressure gaseous refrigerant, discharged from the compressor 110, may flow into the second valve 172 through the first intermediate pipe 170. The second valve 172 may be switched to connect the first intermediate pipe 170 and the gaseous line 150. Accordingly, the refrigerant flowing into the second valve 172 may flow through the gaseous line 150.

The refrigerant flowing through the gaseous line 150 may pass through the first total valve 31, and the first shut-off valve 41 disposed at the inlet of each of the plurality of indoor units 20, to be supplied to each of the plurality of indoor units 20. The refrigerant, supplied to each of the plurality of indoor units 20, may pass through the indoor expansion valve 212 to flow into the indoor heat exchanger 210, to be condensed in the indoor heat exchanger 210. Accordingly, the plurality of indoor units 20 may perform a heating operation.

The refrigerant, discharged from the plurality of indoor units 20, may pass through the second shut-off valve 42, disposed at the outlet of each of the plurality of indoor units 20, and the second total valve 32, to flow through the liquid line 140. The refrigerant flowing through the liquid line 140 may be distributed to the first distribution pipe 141 and the second distribution pipe 142.

The refrigerant distributed to the first distribution pipe 141 may pass through the first outdoor expansion valve 143 to be supplied to the first outdoor heat exchanger 130*a*. The refrigerant supplied to the first outdoor heat exchanger 130*a* may be evaporated in the first outdoor heat exchanger 130*a* to be discharged therefrom.

The refrigerant distributed to the second distribution pipe 142 may pass through the second outdoor expansion valve 144 to be supplied to the second outdoor heat exchanger 130*b*. The refrigerant supplied to the second outdoor heat exchanger 130*b* may be evaporated in the second outdoor heat exchanger 130*b* to be discharged therefrom.

The refrigerant discharged from the first outdoor heat exchanger 130*a* and the refrigerant discharged from the second outdoor heat exchanger 130*b* may be mixed in the outdoor pipe 149. The refrigerant mixed in the outdoor pipe 149 may flow into the first valve 171 through the outdoor pipe 149. The first valve 171 is switched to connect the second intermediate pipe 180 and the outdoor pipe 149. Accordingly, the refrigerant mixed in the outdoor pipe 149 may flow through the second intermediate pipe 180.

The refrigerant flowing through the second intermediate pipe 180 may pass through the accumulator 112 to be drawn into the compressor 110. Accordingly, the air conditioner 1 according to an embodiment may heat the indoor space by repeating the above cycle.

Figure 3:
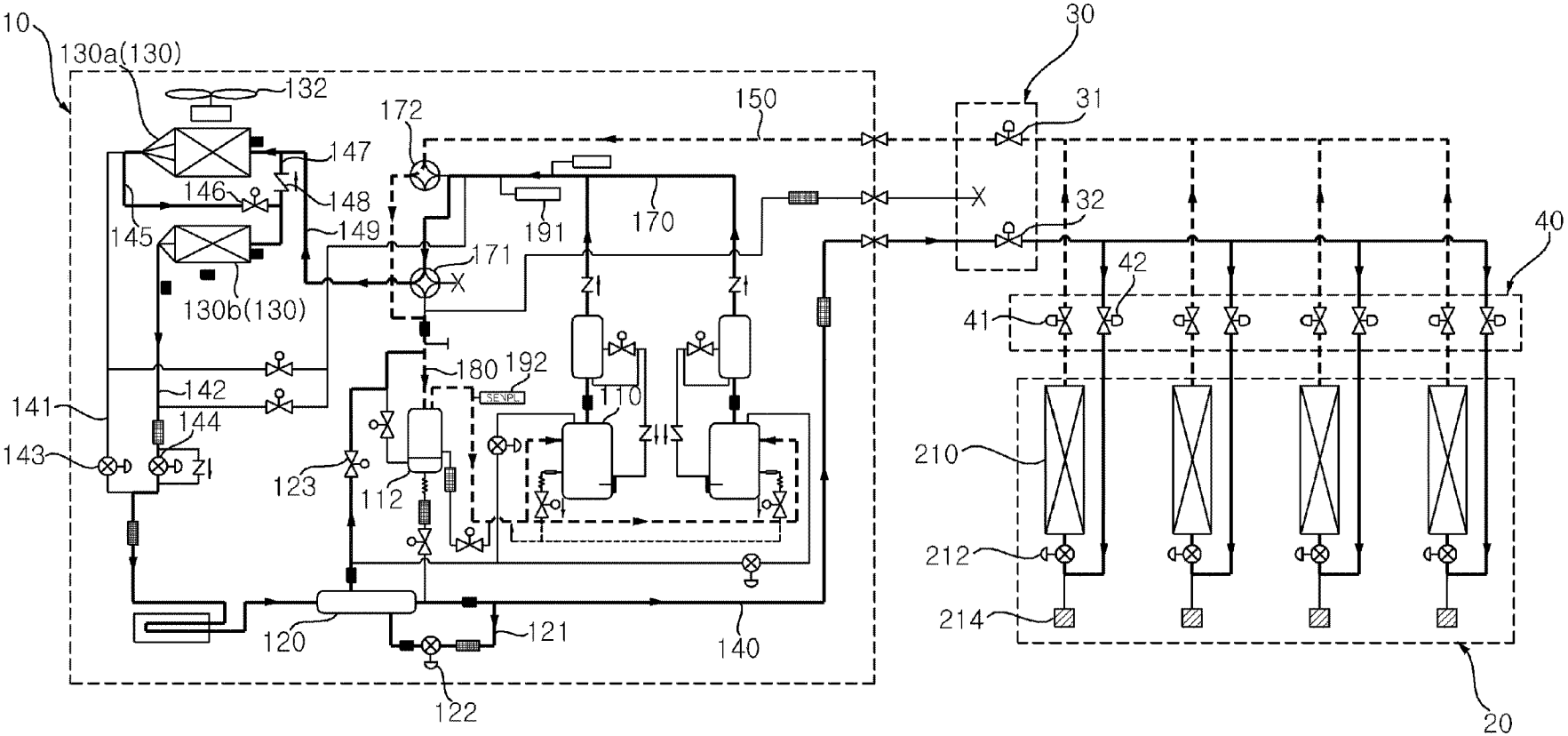
FIG. 3 is a schematic diagram illustrating refrigerant flow during a cooling operation of an air conditioner according to an embodiment.

FIG. 3 is a schematic diagram illustrating refrigerant flow during a cooling operation of an air conditioner according to an embodiment. Hereinafter, operation of an air conditioner during a cooling operation and a refrigerant flow therein will be described with reference to FIG. 3.

A high-pressure gaseous refrigerant, discharged from the compressor 110, may flow into the first valve 171 through the first intermediate pipe 170. The first valve 171 is switched to connect the first intermediate pipe 170 and the outdoor pipe 149. Accordingly, the refrigerant flowing into the first valve 171 may be introduced into the outdoor pipe 149.

The check valve 148 may block the refrigerant, introduced into the outdoor pipe 149, from flowing to the second bypass pipe 147. Accordingly, the refrigerant introduced into the outdoor pipe 149 may be supplied to the first outdoor heat exchanger 130*a*.

The refrigerant supplied to the first outdoor heat exchanger 130*a* may be condensed in the first outdoor heat exchanger 130*a* and discharged to the first distribution pipe 141. The refrigerant discharged to the first distribution pipe 141 may be introduced into the first bypass pipe 145 as the first outdoor expansion valve 143 is closed. A portion of the refrigerant introduced into the first bypass pipe 145 may flow into the second bypass pipe 147 to be supplied again to the first outdoor heat exchanger 130*a*, and a portion of the remaining refrigerant introduced into the first bypass pipe 145 may be supplied to the second outdoor heat exchanger 130*b*.

The refrigerant supplied to the second outdoor heat exchanger 130*b* may be condensed in the second outdoor heat exchanger 130*b* and discharged to the second distribution pipe 143.

The refrigerant discharged to the second distribution pipe 142 may flow through the liquid line 140. The refrigerant flowing through the liquid line 140 may be supplied to the subcooler 120 to be subcooled and discharged.

A portion of the refrigerant discharged from the subcooler 120 may flow into the subcooling pipe 121. The refrigerant flowing into the subcooling pipe 121 may be expanded by passing through a subcooling expansion valve 122, to be phase-changed into a low-temperature gaseous refrigerant. The refrigerant, having passed through the subcooling expansion valve 122, may be heat exchanged with the refrigerant flowing into the subcooler 120, and then may pass through the suction valve 123 to flow into the second intermediate pipe 180.

A portion of the remaining refrigerant, having passed through the subcooler 120, may pass through the second shut-off valve 42 disposed at the inlet of the indoor unit 20, to be supplied to each of the plurality of indoor units 20.

The refrigerant supplied to each of the plurality of indoor units 20 may be expanded by passing through the indoor expansion valve 212, and may be evaporated in the plurality of indoor heat exchangers 210. Accordingly, the plurality of indoor units 20 may perform a cooling operation.

The refrigerant discharged from the plurality of indoor units 20 may pass through the first shut-off valve 41, disposed at the outlet of the plurality of indoor units 20, and the first total valve 31, to flow through the gaseous line 150. The refrigerant flowing through the gaseous line 150 may be introduced into the second valve 172. The second valve 172 may be switched to connect the gaseous line 150 and the second intermediate pipe 180. Accordingly, the refrigerant introduced into the second valve 172 may flow into the second intermediate pipe 180.

The refrigerant, flowing into the second intermediate pipe 180, may be mixed with the refrigerant flowing from the subcooling pipe 121, and may pass through the accumulator 112 to be drawn into the compressor 110. Accordingly, the air conditioner 1 according to an embodiment may cool the indoor space by repeating the above cycle.

Figure 4:
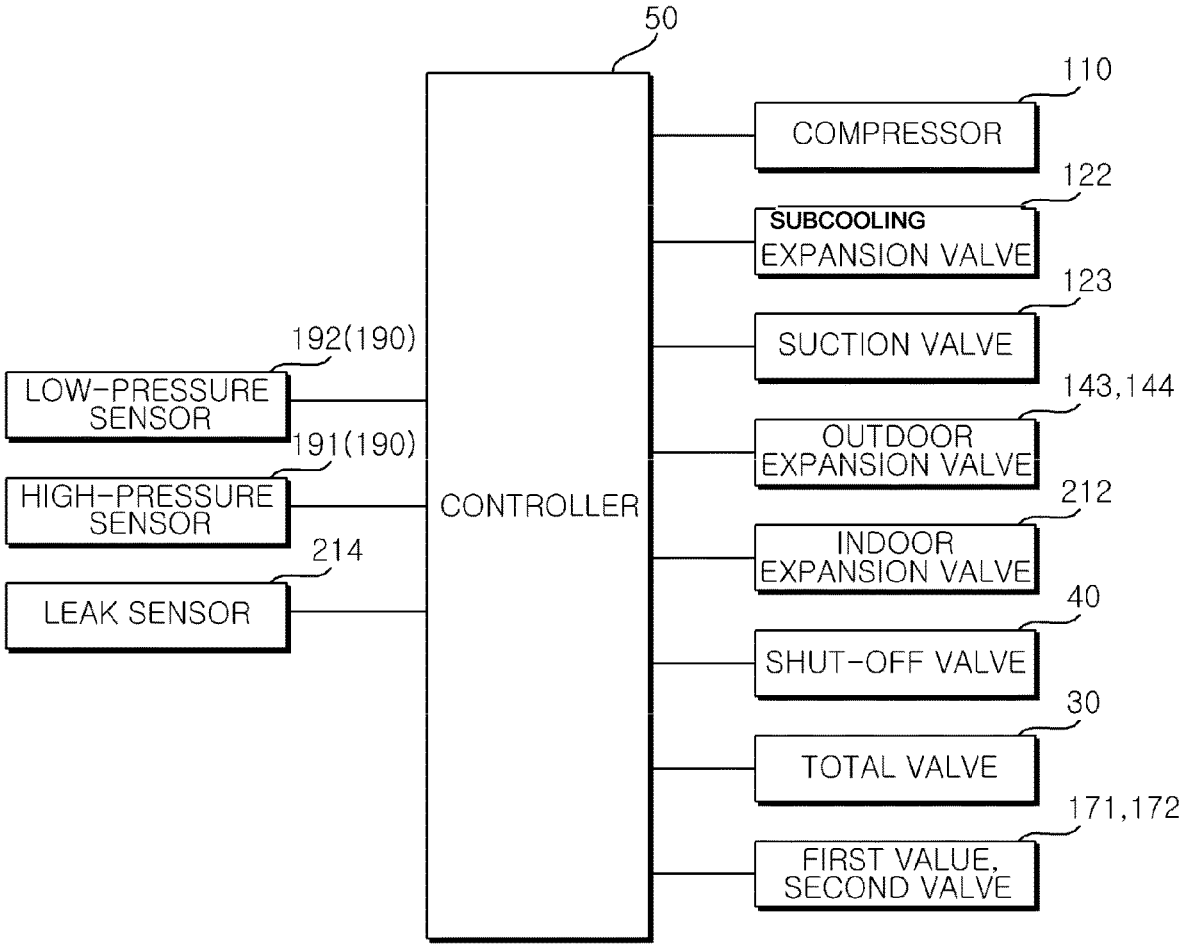
FIG. 4 is a block diagram of a controller and related components according to an embodiment.

FIG. 4 is a block diagram of a controller and related components according to an embodiment. Referring to FIG. 4, the air conditioner 1 according to an embodiment may include a pressure sensor 190 configured to measure system pressure; a leak sensor 214 configured to sense refrigerant leakage into the indoor unit 20; and a controller 50 configured to control operation of the air conditioner 1.

The pressure sensor 190 may include a high-pressure sensor 191 that measures a high system pressure and a low-pressure sensor 192 that measures a low system pressure. The high system pressure may refer to a discharge pressure of the compressor 110, and the low system pressure may refer to a suction pressure of the compressor 110.

The high-pressure sensor 191 may be disposed at the outlet of the compressor 110. The low-pressure sensor 192 may be disposed at the inlet of the compressor 110. Accordingly, by comparing the pressure measured by the pressure sensor 190 with a set system pressure, it is possible to determine whether the system pressure is stable.

The leak sensor 214 may be disposed on or at one side of the indoor unit 20. When there are a plurality of indoor units 20, the leak sensor 214 may be provided for each of the plurality of indoor units 20. The leak sensor 214 may be a temperature sensor that determines leakage of refrigerant by measuring a temperature of refrigerant tubes of the indoor units 20, or may be a sensor that determines leakage of refrigerant by sensing the presence of refrigerant in the air and measures a concentration of the refrigerant leakage.

The controller 50 may control the first valve 171 and the second valve 172 so that the first valve 171 and the second valve 172 may be switched according to the cooling operation or the heating operation of the air conditioner 1. The controller 50 may operate or stop the compressor 110, or may control the compressor 110 to reduce a frequency of the compressor 110.

By controlling the opening or closing of the suction valve 123, the controller 50 may control the suction valve 123 to adjust a flow of refrigerant flowing into the inlet of the compressor 110. By controlling the opening of the subcooling expansion valve 122, the outdoor expansion valves 143 and 144, and the indoor expansion valve 212, the controller 50 may control the subcooling expansion valve 122, the outdoor expansion valves 143 and 144, and the indoor expansion valve 212 to expand the refrigerant.

By opening and closing the subcooling expansion valve 122, the outdoor expansion valves 143 and 144, and the indoor expansion valve 212, the controller 50 may control the subcooling expansion valve 122, the outdoor expansion valves 143 and 144, and the indoor expansion valve 212 to control the refrigerant flow. By opening and closing the total valve 30 and the shut-off valve 40, the controller 50 may control the total valve 30 and the shut-off valve 40 to control the refrigerant flow between the outdoor unit 10 and the indoor unit 20.

Figure 5:
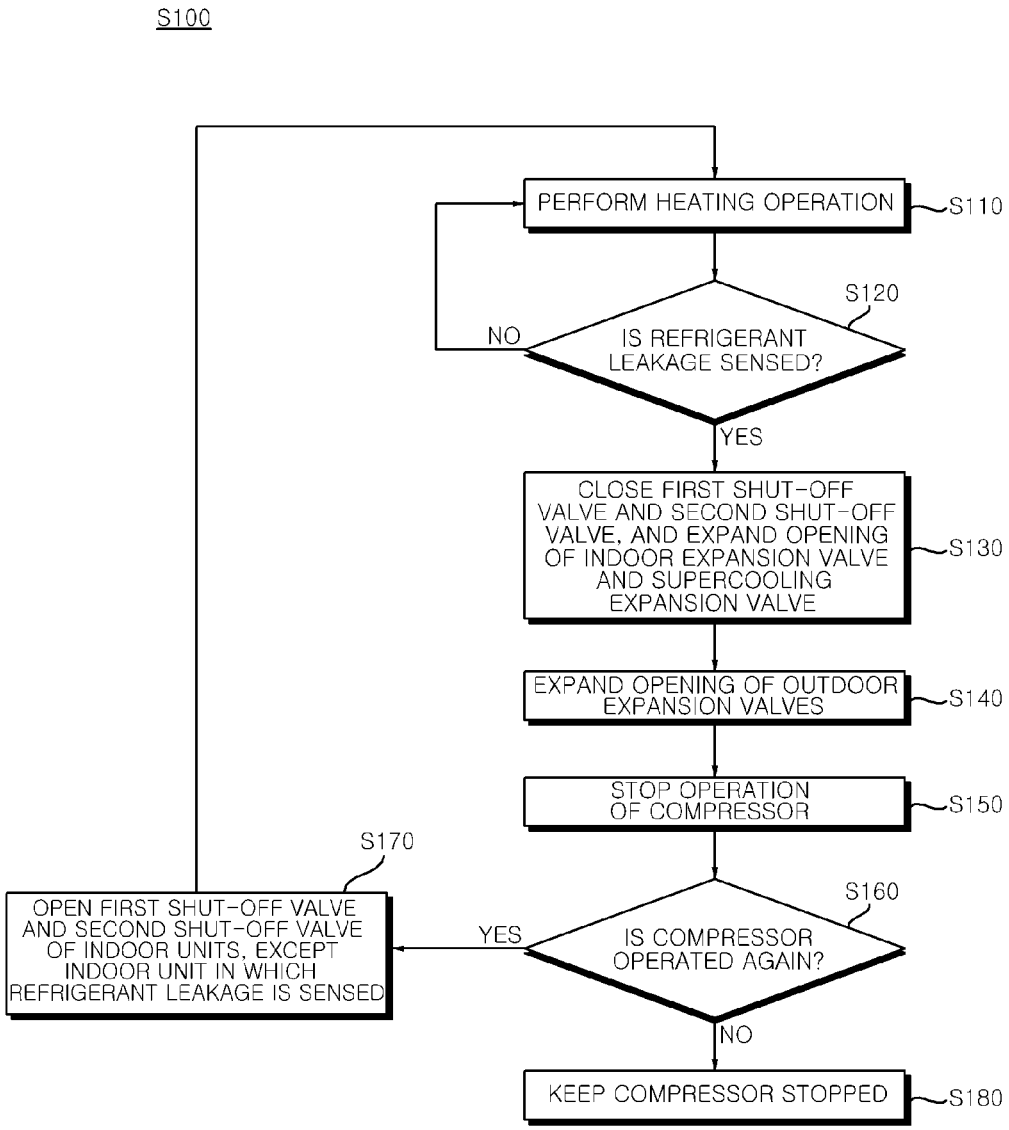
FIG. 5 is a flowchart of a method for controlling an air conditioner when refrigerant leakage occurs in an indoor unit during a heating operation of the air conditioner according to an embodiment.

FIG. 5 is a flowchart of a method of controlling an air conditioner when refrigerant leakage occurs in an indoor unit during a heating operation of the air conditioner according to an embodiment. Hereinafter, a method (S100) for controlling an air conditioner for minimizing refrigerant leakage into an indoor space when the refrigerant leakage occurs in the indoor unit during the heating operation of the air conditioner will be described with reference to FIG. 5.

By controlling the compressor 110 to operate, the controller 50 may control the air conditioner 1 to perform the heating operation (S110), thereby heating the indoor space. The controller 50 may sense refrigerant leakage in at least one of a plurality of indoor units 20 using the leak sensor 214 during the heating operation of the air conditioner 1 (S120). When no refrigerant leakage is sensed in the indoor units 20, the air conditioner 1 may continuously perform the heating operation.

By contrast, upon sensing the refrigerant leakage in the indoor unit 20, the controller 50 may store a position of the indoor unit 20 in which the refrigerant leakage is sensed. Upon sensing the refrigerant leakage in the indoor unit 20, the controller 50 may close the first shut-off valve 41 disposed at the inlet of each of the plurality of indoor units 20, and the second shut-off valve 42 disposed at the outlet of each of the plurality of indoor units 20 (S130).

In this case, the inlet of each of the plurality of indoor units 20 may be connected to the gaseous line 150, and the outlet of each of the plurality of indoor units 20 may be connected to the liquid line 140. It may take a predetermined period of time from when the first shut-off valve 41 and the second shut-off valve 42 begin to be closed to when the first shut-off valve 41 and the second shut-off valve 42 are fully closed. The predetermined period of time may be about one minute or so and may be referred to as a set period of time.

Upon sensing the refrigerant leakage in the indoor unit 20, the controller 50 may expand the opening of the indoor expansion valve 212, and the indoor expansion valve 212 may be fully opened (S130). Accordingly, the indoor unit 20 may communicate with the liquid line 140.

Upon sensing the refrigerant leakage in the indoor unit 20, the controller 50 may expand the opening of the subcooling expansion valve 122, and the subcooling expansion valve 122 may be fully opened (S130). Accordingly, the liquid line 140 may be connected to the inlet of the compressor 110 via the subcooling pipe 121.

In the case in which the suction valve 123 is disposed in the subcooling pipe 121, the controller 50 may fully open the suction valve 123 and the subcooling expansion valve 122.

Upon sensing the refrigerant leakage in the indoor unit 20, the controller 50 may expand the opening of the outdoor expansion valves 143 and 144, and the outdoor expansion valves 143 and 144 may be fully opened (S140). Upon sensing the refrigerant leakage in the indoor unit 20, the controller 50 may stop the operation of the compressor 110. Accordingly, while the shut-off valve 40 is closed, it is possible to prevent the refrigerant from flowing into the indoor unit 20 (S150).

When the set period of time has elapsed after the first shut-off valve 41 and the second shut-off valve 42 begin to be closed until the first shut-off valve 41 and the second shut-off valve 42 are fully closed, the controller 50 may determine whether to operate the compressor 110 again (S160). Upon determining to operate the compressor 110 again, the controller 50 may open the first shut-off valve 41 and the second shut-off valve 42 of the indoor units 20, except the indoor unit 20 in which the refrigerant leakage is sensed (S170). Accordingly, the air conditioner 1 may continuously perform the heating operation of the indoor units 20, except the indoor unit 20 in which the refrigerant leakage is sensed.

Upon determining not to operate the compressor 110 again, the controller 50 may maintain the compressor 110 stopped (S180). In this manner, when the refrigerant leakage occurs in at least one of the plurality of indoor units 20 during the heating operation of the air conditioner 1, the controller 50 may control the shut-off valve 40 to block refrigerant flow between the outdoor unit 10 and the indoor unit 20.

In addition, when the refrigerant leakage occurs in the indoor unit 20 during the heating operation of the air conditioner 1, the controller 50 may reduce the pressure of the liquid line 140 to a level similar to an indoor atmospheric pressure by connecting the liquid line 140 and the inlet of the compressor 110 which corresponds to a low system pressure. Accordingly, a pressure difference between the indoor atmospheric pressure and the pressure of the liquid line 140 is reduced, such that it is possible to minimize an amount of refrigerant leaking into the indoor space during a period of time until the shut-off valve 40 is actually closed.

Unlike the above example, in the case in which a single indoor unit 20 is provided, the determination whether to operate the compressor 110 again (S160) may not be included. In addition, when the single indoor unit 20 is provided, only the total valve 30 may be disposed in the air conditioner 1 instead of the shut-off valve 40, and when the refrigerant leakage occurs in the indoor unit 20, the total valve 30 may operate as the shut-off valve 40 as described above with reference to FIG. 5.

Further, even when there are a plurality of indoor units 20, if it is not required to operate the compressor 110 again, the determination whether to operate the compressor 110 again (S160) may not be included. In this case, only the total valve 30 may be disposed in the air conditioner 1 instead of the shut-off valve 40, and when the refrigerant leakage occurs in the indoor unit 20, the total valve 30 may operate as the shut-off valve 40 as described above with reference to FIG. 5.

Figure 6:
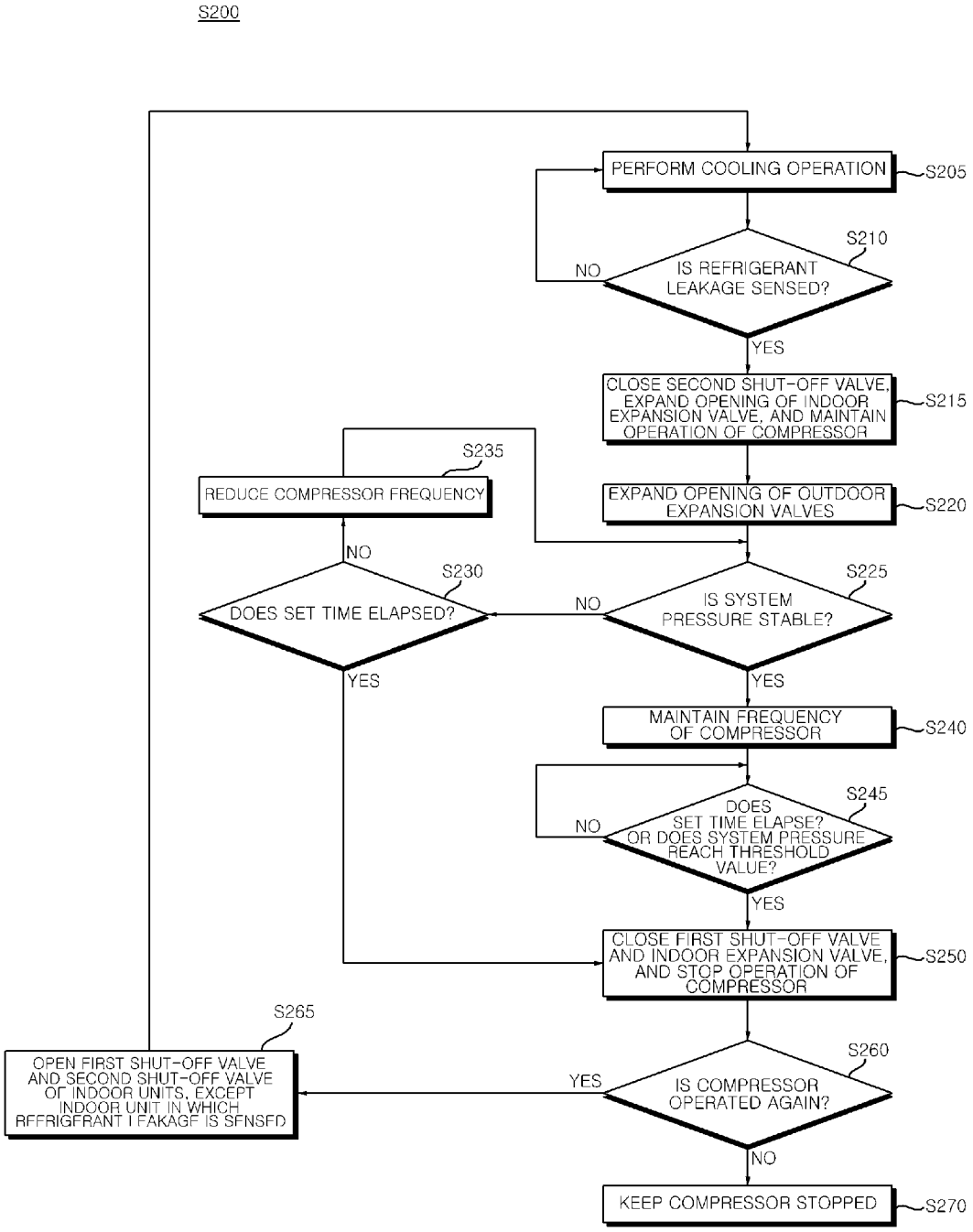
FIG. 6 is a flowchart of a method for controlling an air conditioner when refrigerant leakage occurs in an indoor unit during a cooling operation of the air conditioner according to an embodiment.

FIG. 6 is a flowchart of a method for controlling an air conditioner when refrigerant leakage occurs in an indoor unit during a cooling operation of the air conditioner according to an embodiment. Hereinafter, the method (S200) for controlling an air conditioner for minimizing refrigerant leakage into the indoor space when the refrigerant leakage is sensed in the indoor unit during the cooling operation of the air conditioner will be described with reference to FIG. 6.

By controlling the compressor 110 to operate, the controller 50 may control the air conditioner 1 to perform the cooling operation (S205), thereby cooling the indoor space. The controller 50 may sense refrigerant leakage in at least one of a plurality of indoor units 20 using the leak sensor 214 during the cooling operation of the air conditioner 1 (S210). When no refrigerant leakage is sensed in the indoor units 20, the air conditioner 1 may continuously perform the cooling operation.

By contrast, upon sensing the refrigerant leakage in the indoor unit 20, the controller 50 may store a position of the indoor unit 20 in which the refrigerant leakage is sensed. Upon sensing the refrigerant leakage in the indoor unit 20, the controller 50 may close the second shut-off valve 42 disposed at the inlet of each of the plurality of indoor units 20 (S215).

The inlet of each of the plurality of indoor units 20 may be connected to the liquid line 140, and the outlet of each of the plurality of indoor units 20 may be connected to the gaseous line 150. It may take a predetermined period of time from when the second shut-off valve 42 begins to be closed to when the second shut-off valve 42 is fully closed. The predetermined period of time may be about one minute or so and may be referred to as a set period of time.

Upon sensing the refrigerant leakage in the indoor unit 20, the controller 50 may expand the opening of the indoor expansion valve 212, and the indoor expansion valve 212 may be fully opened (S215). By maintaining the operation of the compressor 110, the controller 50 may return the refrigerant to the outdoor unit 10 (S215).

By closing the outdoor expansion valves 143 and 144, the controller 50 may prevent a high-pressure refrigerant from flowing into the indoor unit 20 (S220).

By comparing a system pressure, measured by the pressure sensor 190, with a set or predetermined pressure, the controller 50 may determine whether the system pressure is stable (S225).

Herein, the term "system pressure" may refer to a high system pressure and a low system pressure. The high system pressure may refer to a discharge pressure of the compressor, and the low system pressure may refer to a suction pressure of the compressor.

The high system pressure may be measured by the high-pressure sensor 191 disposed at the outlet of the compressor, and the low system pressure may be measured by the low-pressure sensor 192 disposed at the inlet of the compressor. If the high pressure measured by the high-pressure sensor 191 is less than or equal to a first set or predetermined pressure, the controller 50 may determine that the system pressure is stable. The first set or predetermined pressure may correspond to a pressure level that keeps the discharge pipe of the compressor 110 safe from the risk of rupture. The first set or predetermined pressure may correspond to an experimental value obtained in experiments.

If the pressure measured by the low-pressure sensor 192 is greater than or equal to a second set or predetermined pressure, the controller 50 may determine that the system pressure is stable. The second set or predetermined pressure may correspond to a pressure level that keeps a drive component for operating the compressor 110 safe from the risk of damage. The second set or predetermined pressure may correspond to an experimental value obtained in experiments.

The determination as to whether the system pressure is stable may be made in such a manner that if the high system pressure measured by the high-pressure sensor 191 exceeds a first set or predetermined value, or if the low system pressure measured by the low-pressure sensor 192 is less than a second set or predetermined value, the controller 50 may determine that the system pressure is unstable; and if the high system pressure measured by the high-pressure sensor 191 is less than or equal to the first set or predetermined value, and the low system pressure measured by the low-pressure sensor 192 is less than or equal to the second set or predetermined value, the controller 50 may determine that the system pressure is stable.

If the system pressure is unstable, the controller 50 may determine whether a set or predetermined period of time has elapsed after the second shut-off valve 42 begins to be closed (S230). If the system pressure is unstable, and the set period of time has not elapsed after the second shut-off valve 42 begins to be closed, the controller 50 may reduce a frequency of the compressor 110 (S235), to control the system pressure.

If the system pressure is unstable, and the set period of time has elapsed after the second shut-off valve 42 begins to be closed, the controller 50 may close the first shut-off valve 41 and the indoor expansion valve 212 and may stop operation of the compressor 110 (S250).

If the system pressure is stable, the controller 50 may operate the compressor 110 while maintaining the frequency of the compressor 110 (S240). When continuously operating the compressor 110 while maintaining the frequency of the compressor 110, the controller 50 may determine whether the set period of time has elapsed after the second shut-off valve 42 begins to be closed, or whether the system pressure reaches a threshold value (S245).

The determination as to whether the system pressure reaches a threshold value may be made based on whether the high system pressure, measured by the high-pressure sensor 191, reaches the first set pressure or whether the low system pressure, measured by the low-pressure sensor 192, reaches the second set pressure.

If the set period of time has elapsed after the second shut-off valve 42 begins to be closed, or if the system pressure reaches the threshold value, the controller 50 may close the first shut-off valve 41 and the indoor expansion valve 212, and may stop the operation of the compressor 110 (S250).

When the set period of time has elapsed after the first shut-off valve 41 begins to be closed until the first shut-off valve 41 is fully closed, the controller 50 may determine whether to operate the compressor 110 again (S260). Upon determining to operate the compressor 110 again, the controller 50 may open the first shut-off valve 41 and the second shut-off valve 42 of the indoor units 20, except the indoor unit 20 in which the refrigerant leakage is sensed (S265). Accordingly, the air conditioner 1 may continuously perform the cooling operation of the indoor units 20, except for the indoor unit 20 in which the refrigerant leakage is sensed.

Upon determining not to operate the compressor 110 again, the controller 50 may maintain the compressor 110 stopped (S270). In this manner, when the refrigerant leakage occurs in at least one of the plurality of indoor units 20 during the cooling operation of the air conditioner 1, the controller 50 may control the compressor 110 to return the refrigerant to the outdoor unit 10. Accordingly, it is possible to minimize an amount of refrigerant leaking into the indoor space during a period of time until the shut-off valve 40 is actually closed.

Unlike the above example, in a case in which a single indoor unit 20 is provided, the determination whether to operate the compressor 110 again (S260) may not be included. In addition, when the single indoor unit 20 is provided, only the total valve 30 may be disposed in the air conditioner 1 instead of the shut-off valve 40, and when the refrigerant leakage occurs in the indoor unit 20, the total valve 30 may operate as the shut-off valve 40 as described above with reference to FIG. 6.

Further, even when there are a plurality of indoor units 20, if it is not required to operate the compressor 110 again, the determination whether to operate the compressor 110 again (S260) may not be included. In this case, only the total valve 30 may be disposed in the air conditioner 1 instead of the shut-off valve 40, and when the refrigerant leakage occurs in the indoor unit 20, the total valve 30 may operate as the shut-off valve 40, as described above with reference to FIG. 6.

The air conditioner according to embodiments disclosed herein has at least one or more of the following advantages.

First, upon sensing refrigerant leakage in the indoor unit during the heating operation of the air conditioner, the air conditioner may connect the liquid line to the inlet of the compressor while the shut-off valve of the indoor unit is closed, such that a pressure difference between the pressure of the liquid line and the indoor atmospheric pressure may be reduced, thereby minimizing an amount of refrigerant leaking into the indoor space.

Second, upon sensing refrigerant leakage in the indoor unit during the cooling operation of the air conditioner, the air conditioner operates the compressor while the shut-off valve of the indoor unit is closed, to return the refrigerant in the indoor unit to the outdoor unit, thereby minimizing an amount of refrigerant leaking into the indoor space.

Third, by blocking the refrigerant from leaking into the indoor space, the air conditioner may operate only the indoor units in which no refrigerant leakage occurs.

In order to achieve the above advantages, embodiments disclosed herein provide an air conditioner capable of minimizing an amount of refrigerant leaking into an indoor space while a shut-off valve is closed, when refrigerant leakage is sensed in an indoor unit. Embodiments disclosed herein further provide an air conditioner capable of operating indoor units, except an indoor unit in which refrigerant leakage occurs, after blocking a refrigerant from leaking into the indoor units of a multi-type air conditioner.

Embodiments disclosed herein are not limited to the aforementioned advantages and other advantages not described herein will be clearly understood by those skilled in the art from the following description.

Embodiments disclosed herein provide an air conditioner that may include an outdoor unit having a compressor configured to compress a refrigerant; at least one indoor unit having an indoor heat exchanger, in which the refrigerant is heat exchanged, an indoor expansion valve that expands the refrigerant by adjusting an opening, and a leak sensor that senses leakage of the refrigerant; a gaseous line that connects the outdoor unit and the at least one indoor unit and through which gaseous refrigerant flows; a liquid line that connects the outdoor unit and the at least one indoor unit and through which liquid refrigerant flows; a first shut-off valve disposed adjacent to the at least one indoor unit that opens and closes the gaseous line; a second shut-off valve disposed adjacent to the at least one indoor unit that opens and closes the liquid line; a subcooling pipe branching off from the liquid line and connected to an inlet of the compressor; a subcooling expansion valve that expands a refrigerant, flowing through the subcooling pipe, by adjusting an opening thereof; and a controller configured to control operation of the compressor and to control opening and closing of the first shut-off valve, the second shut-off valve, the indoor expansion valve, and the subcooling expansion valve. When the leak sensor senses the leakage of the refrigerant, the controller may close the first shut-off valve and the second shut-off valve, and expand the opening of the indoor expansion valve and the subcooling expansion valve.

The outdoor unit may include an outdoor expansion valve disposed in the liquid line that expands the refrigerant by adjusting an opening. When the leak sensor senses the leakage of the refrigerant, the controller may expand the opening of the outdoor expansion valve. When the leak sensor senses the leakage of the refrigerant, the controller may stop the operation of the compressor.

Embodiments disclosed herein provide an air conditioner that may include an outdoor unit having a compressor configured to compress a refrigerant; at least one indoor unit having an indoor heat exchanger, in which the refrigerant is heat exchanged, an indoor expansion valve that expands the refrigerant by adjusting an opening thereof and a leak sensor that senses leakage of the refrigerant; a gaseous line that connects the outdoor unit and the at least one indoor unit and through which gaseous refrigerant flows; a liquid line that connects the outdoor unit and the at least one indoor unit and through which liquid refrigerant flows; a first shut-off valve disposed adjacent to the indoor unit that opens and closes the gaseous line; a second shut-off valve disposed adjacent to the indoor unit that opens and closes the liquid line; and a controller configured to control operation of the compressor and to control opening and closing of the first shut-off valve, the second shut-off valve, and the indoor expansion valve. When the leak sensor senses the leakage of the refrigerant, the controller closes the second shut-off valve, expands the opening of the indoor expansion valve, and maintains the operation of the compressor to return the refrigerant to the outdoor unit.

The outdoor unit may include an outdoor expansion valve disposed in the liquid line that expands the refrigerant by adjusting an opening. When the leak sensor senses the leakage of the refrigerant, the controller may close the outdoor expansion valve.

When a system pressure, measured by a pressure sensor, is unstable, the controller may reduce a frequency of the compressor. When a set or predetermined period of time has elapsed after the second shut-off valve begins to be closed, or when the system pressure reaches a threshold value, the controller may close the first shut-off valve and the indoor expansion valve, and may stop the operation of the compressor.

Embodiments disclosed herein provide a method for controlling an air conditioner. The method may include operating a compressor to perform a heating operation; sensing leakage of a refrigerant in at least one indoor unit using a leak sensor; and when the leakage of the refrigerant is sensed, closing a first shut-off valve and a second shut-off valve that control a refrigerant flow between the at least one indoor unit and an outdoor unit, and expanding an opening of an indoor expansion valve, and a subcooling expansion valve disposed in a subcooling pipe that connects a liquid line and an inlet of the compressor.

The method may further include, when the leakage of the refrigerant is sensed, expanding an opening of an outdoor expansion valve. The method may further include, when the leakage of the refrigerant is sensed, stopping operation of the compressor to prevent the refrigerant from flowing into the indoor unit.

A plurality of indoor units may be provided. Each of the plurality of indoor units may include the first shut-off valve formed at an inlet, the second shut-off valve formed at an outlet, the indoor expansion valve, and the leak sensor. The sensing of the leakage of the refrigerant in the indoor units using the leak sensor may further include storing a position of an indoor unit, in which the leakage of the refrigerant occurs, among the plurality of indoor units, and when the leakage of the refrigerant is sensed, closing the first shut-off valve and the second shut-off valve of the plurality of indoor units, and expanding an opening of the indoor expansion valve.

The method may further include opening the first shut-off valve and the second shut-off valve of the indoor units, except the indoor unit in which the leakage of the refrigerant occurs, and operating the compressor again.

Embodiments disclosed herein provide a method for controlling an air conditioner. The method may include operating a compressor to control a plurality of indoor units to perform a cooling operation; sensing leakage of a refrigerant in the plurality of indoor units using a leak sensor; and when the leakage of the refrigerant is sensed, closing a second shut-off valve, expanding an opening of an indoor expansion valve, and maintaining operation of the compressor to return the refrigerant to an outdoor unit. The method may further include, when the leakage of the refrigerant is sensed, closing an outdoor expansion valve.

The method may further include comparing a system pressure with a set or predetermined pressure to determine whether the system pressure is stable; and when the system pressure is unstable, reducing a frequency of the compressor. The method may further include, when a set or predetermined period of time has elapsed after the second shut-off valve begins to be closed, closing a first shut-off valve and the indoor expansion valve, and stopping the compressor.

A plurality of indoor units may be provided. Each of the plurality of indoor units may include the first shut-off valve formed at an outlet, the second shut-off valve formed at an inlet, the indoor expansion valve, and the leak sensor. The sensing of the leakage of the refrigerant in the plurality of indoor units using the leak sensor may further include storing a position of an indoor unit, in which the leakage of the refrigerant occurs, among the plurality of indoor units; when the leakage of the refrigerant is sensed, closing the second shut-off valve of the plurality of indoor units, and expanding an opening of the indoor expansion valve; and when a set or predetermined period of time has elapsed after the second shut-off valve begins to be closed, closing the first shut-off valve and the indoor expansion valve, and stopping the compressor.

The method of controlling an air conditioner may further include opening the first shut-off valve and the second shut-off valve of the indoor units, except the indoor unit in which the leakage of the refrigerant occurs, and operating the compressor again.

While embodiments have been particularly shown and described with reference to embodiments thereof, it will be understood by those skilled in the art that the embodiments are not limited to those exemplary embodiments and various changes in form and details may be made therein without departing from the scope and spirit as defined by the appended claims and should not be individually understood from the technical spirit or prospect.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing are advantageous.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an outdoor unit having a compressor configured to compress a refrigerant, a first pressure sensor disposed at an inlet of the compressor, and a second pressure sensor disposed at an outlet of the compressor;

at least one indoor unit having at least one indoor heat exchanger, in which the refrigerant is heat exchanged, at least one indoor expansion valve that expands the refrigerant by adjusting an opening thereof, and at least one leak sensor that senses leakage of the refrigerant;

a gaseous line that connects the outdoor unit and the at least one indoor unit and through which gaseous refrigerant flows;

a liquid line that connects the outdoor unit and the at least one indoor unit and through which liquid refrigerant flows;

at least one first shut-off valve disposed adjacent to the at least one indoor unit that opens and closes the gaseous line;

at least one second shut-off valve disposed adjacent to the at least one indoor unit that opens and closes the liquid line;

a subcooling pipe branched off from the liquid line and connected to an inlet of the compressor;

a subcooling expansion valve that expands refrigerant, flowing through the subcooling pipe, by adjusting an opening thereof; and a controller configured to control operation of the compressor and to control opening and closing of the at least one first shut-off valve, the at least one second shut-off valve, the at least one indoor expansion valve, and the subcooling expansion valve, wherein the outdoor unit comprises an outdoor expansion valve disposed in the liquid line and expanding the refrigerant by adjusting an opening, wherein when the at least one leak sensor senses the leakage of the refrigerant during a heating operation of the air conditioner, the controller is to:

close the at least one first shut-off valve and the at least one second shut-off valve;

expand the opening of the at least one indoor expansion valve and the opening of the subcooling expansion valve; and expand the opening of the outdoor expansion valve, wherein when the at least one leak sensor senses the leakage of the refrigerant during a cooling operation of the air conditioner, the controller is to:

close the at least one second shut-off valve, expand the opening of the at least one indoor expansion valve, and reduce a frequency of the compressor when low pressure measured by the first pressure sensor is less than a first set value or high pressure measured by the second pressure sensor is higher than a second set value.

2. The air conditioner of claim 1, wherein when the at least one leak sensor senses the leakage of the refrigerant, the controller stops the operation of the compressor.

3. The air conditioner of claim 1, wherein when the at least one leak sensor senses the leakage of the refrigerant during the cooling operation, the controller is configured to maintain the operation of the compressor to return the refrigerant to the outdoor unit.

4. The air conditioner of claim 3, wherein the at least one indoor unit comprises a plurality of indoor units, and wherein:

the first shut-off valve, the second shut-off valve, and the leak sensor are provided for each of the plurality of indoor units; and when the leak sensor senses the leakage of the refrigerant, the controller stores a position of an indoor unit, in which the leakage of the refrigerant occurs, among the plurality of indoor units.

5. The air conditioner of claim 4, wherein the controller opens the first shut-off valve and the second shut-off valve of each of the plurality of indoor units, except for the indoor unit in which the leakage of the refrigerant occurs, and operates the compressor again.

6. The air conditioner of claim 1, wherein when the at least one leak sensor senses the leakage of the refrigerant during the cooling operation of the air conditioner, the controller is to:

expand the opening of the at least one outdoor expansion valve, and maintain the operation of the compressor to return the refrigerant to the outdoor unit.

7. The air conditioner of claim 6, wherein when a predetermined period of time has elapsed after the at least one second shut-off valve begins to be closed, or when the system pressure reaches a predetermined value, the controller closes the at least one first shut-off valve and the at least one indoor expansion valve, and stops the operation of the compressor.

8. A method for controlling an air conditioner, the method comprising:

operating a compressor to perform a heating operation or a cooling operation;

sensing leakage of a refrigerant in at least one indoor unit using at least one leak sensor;

when the leakage of the refrigerant is sensed during the heating operation, beginning a closing process of closing at least one first shut-off valve and at least one second shut-off valve that control refrigerant flow between the at least one indoor unit and an outdoor unit, and expanding an opening of at least one indoor expansion valve, expanding an opening of a subcooling expansion valve disposed in a subcooling pipe that connects a liquid line and an inlet of the compressor, and expanding an opening of at least one outdoor expansion valve disposed in the liquid line; and when the leakage of the refrigerant is sensed in the cooling operation, closing the at least one second shut-off valve that control a refrigerant flow between the at least one indoor unit and the outdoor unit, and expanding the opening of an indoor expansion valve, and reducing a frequency of the compressor when low pressure measured by a first pressure sensor disposed at an inlet of the compressor is less than a first set value or high pressure measured by a second pressure sensor disposed at an outlet of the compressor is higher than a second set value.

9. The method of claim 8, further comprising, when the leakage of the refrigerant is sensed, stopping operation of the compressor to prevent the refrigerant from flowing into the at least one indoor unit.

10. The method of claim 9, wherein the at least one indoor unit comprises a plurality of indoor units, wherein each of the plurality of indoor units comprises the first shut-off valve formed at an inlet thereof, the second shut-off valve formed at an outlet thereof, the indoor expansion valve, and the leak sensor, wherein the sensing of the leakage of the refrigerant in the plurality of indoor units using the leak sensor further comprises:

storing a position of an indoor unit, in which the leakage of the refrigerant occurs, among the plurality of indoor units; and when the leakage of the refrigerant is sensed, closing the first shut-off valve and the second shut-off valve of the plurality of indoor units, and expanding an opening of the indoor expansion valve.

11. The method of claim 10, further comprising opening the first shut-off valve and the second shut-off valve of the plurality of indoor units, except for the indoor unit in which the leakage of the refrigerant occurs, and operating the compressor again.

12. The method of claim 8, wherein when the leakage of the refrigerant is sensed during the cooling operation, expanding the opening of the at least one outdoor expansion valve disposed in the liquid line, and maintaining operation of the compressor to return the refrigerant to the outdoor unit.

13. The method of claim 12, further comprising:

comparing a system pressure with a predetermined pressure to determine whether the system pressure is stable; and when the system pressure is determined to be unstable, reducing a frequency of the compressor.

14. The method of claim 12, further comprising, when a predetermined period of time has elapsed after the at least one second shut-off valve begins to be closed, closing the at least one first shut-off valve and the at least one indoor expansion valve, and stopping the compressor.

15. The method of claim 12, wherein each of the plurality of indoor units comprises the first shut-off valve formed at an outlet thereof, the second shut-off valve formed at an inlet thereof, the indoor expansion valve, and the leak sensor, wherein the sensing of the leakage of the refrigerant in the plurality of indoor units using the leak sensor comprises:

storing a position of an indoor unit, in which the leakage of the refrigerant occurs, among the plurality of indoor units;

when the leakage of the refrigerant is sensed, closing the second shut-off valve of the plurality of indoor units, and expanding an opening of the indoor expansion valve; and when a predetermined period of time has elapsed after the second shut-off valve begins to be closed, closing the first shut-off valve and the indoor expansion valve, and stopping the compressor.

16. The method of claim 15, further comprising opening the first shut-off valve and the second shut-off valve of the plurality of indoor units, except the indoor unit in which the leakage of the refrigerant occurs, and operating the compressor again.

* * * * *